US006247681B1

(12) United States Patent
Gerhardy

(10) Patent No.: US 6,247,681 B1
(45) Date of Patent: Jun. 19, 2001

(54) CARBURETOR FOR AN INTERNAL COMBUSTION ENGINE OF A HAND-HELD WORKING TOOL

(75) Inventor: Reinhard Gerhardy, Korb (DE)

(73) Assignee: Andreas Stihl AG & Co. (DE)

( * ) Notice: Subject to any disclaimer, the term of this patent is extended or adjusted under 35 U.S.C. 154(b) by 0 days.

(21) Appl. No.: 08/598,951

(22) Filed: Feb. 9, 1996

(30) Foreign Application Priority Data

Feb. 10, 1995 (DE) ..... 195 04 400

(51) Int. Cl.[7] ..... F02M 17/04
(52) U.S. Cl. ..... 261/35; 261/41.5; 261/DIG. 68
(58) Field of Search ..... 261/35, 41.5, 69.1, 261/DIG. 68

(56) References Cited

U.S. PATENT DOCUMENTS 3,761,063 * 9/1973 Shibanaka et al. ..... 261/41.5
3,931,372 * 1/1976 Pierlot ..... 261/41.5
4,087,492 * 5/1978 Onishi et al. ..... 261/41.5
4,205,024 * 5/1980 Hirosawa ..... 261/41.5 X
4,242,290 * 12/1980 Handelsman et al. ..... 261/41.5
4,283,354 * 8/1981 Schauer et al. ..... 261/41.5
4,329,964 * 5/1982 Morris ..... 261/41.5 X
4,377,141 * 3/1983 Karino et al. ..... 261/41.5 X
4,447,370 * 5/1984 Kobayashi et al. ..... 261/35
4,495,112 * 1/1985 Itou et al. ..... 261/41.5
4,768,494 * 9/1988 Hale ..... 261/41.5 X
5,002,705 * 3/1991 Kohler ..... 261/35
5,441,673 * 8/1995 Gerhardy ..... 261/41.5 X

* cited by examiner

*Primary Examiner*—Richard L. Chiesa
(74) *Attorney, Agent, or Firm*—Robert W. Becker & Associates

(57) ABSTRACT

A carburetor for an internal combustion engine of a hand-held working tool has a housing and a suction channel with a venturi section arranged in the housing. The suction channel has an inlet and an outlet for allowing air flow therethrough. A throttle is connected in the suction channel so as to be pivotable. A control chamber is provided and a main fuel channel connects the suction channel and the control chamber. An idle fuel channel connects the suction channel and the control chamber. A bypass, having an air supply line and a fuel supply line, is provided for introducing an auxiliary fuel/air mixture during a starting operation of the internal combustion engine to a location of the suction channel downstream of the throttle in a direction of air flow. A closure device for separately closing off in a closed position of the piston the air supply line and the fuel supply line of the bypass is provided so that simultaneously the fuel supply and air supply are shut off before formation of the auxiliary fuel/air mixture.

19 Claims, 3 Drawing Sheets

CARBURETOR FOR AN INTERNAL COMBUSTION ENGINE OF A HAND-HELD WORKING TOOL

BACKGROUND OF THE INVENTION

The present invention relates to a carburetor for an internal combustion engine of a hand-held working tool, especially a diaphragm carburetor comprising a housing and having arranged therein a suction channel with a venturi section. Within the suction channel a throttle is pivotably supported. A control chamber connected with a main fuel channel and an idle channel to the suction channel. A bypass is provided via which, for starting the internal combustion engine, an additional amount of fuel/air mixture is introduced into the suction channel downstream of the throttle.

A diaphragm carburetor for an internal combustion engine is known having a carburetor housing comprising a suction channel with a venturi section and a pivotable throttle arranged in the suction channel. A fuel-filled control chamber is connected via a main fuel channel and an idle channel to the suction channel. In a further housing part connected to the carburetor housing an auxiliary channel is arranged through which during starting of the engine an additional amount of fuel/air mixture is introducible into the suction channel downstream of the throttle. In this embodiment the air supply channel and the fuel supply channel are guided within a mixing channel. At the end of the mixing channel a valve is arranged that opens or closes the access to a further channel which extends to the downstream side of the throttle within the suction channel.

The known arrangement is complicated in its construction and requires additional space external to the actual carburetor housing. Furthermore, a secure sealing at the end of the mixing channel is difficult to achieve so that for safety reasons two independently acting shut-off devices are provided which are arranged in series in the flow direction.

It is therefore an object of the present invention to improve a carburetor of the aforementioned kind such that the auxiliary channel is arranged within the carburetor housing and is inexpensive to manufacture and reliable in its function.

SUMMARY OF THE INVENTION

A carburetor for an internal combustion engine of a hand-held working tool according to the present invention is primarily characterized by:

A housing;

A suction channel with a venturi section arranged in the housing, the suction channel having an inlet and an outlet for allowing air flow therethrough;

A throttle connected in the suction channel so as to be pivotable;

A control chamber;

A main fuel channel connecting the suction channel and the control chamber;

An idle fuel channel connecting the suction channel and the control chamber;

A bypass, comprising an air supply line and a fuel supply line, for introducing an auxiliary fuel/air mixture during a starting operation of the internal combustion engine to a location of the suction channel downstream of the throttle in a direction of air flow; and A closure means for separately closing off in a closed position the air supply line and the fuel supply line of the bypass so that simultaneously the fuel supply and air supply are shut off before formation of the auxiliary fuel/air mixture.

The bypass comprises preferably a parallel bore extending within the housing parallel to the suction channel and a first transverse bore connecting the suction channel and the parallel bore, wherein the first transverse bore opens into the suction channel downstream of the throttle.

Advantageously, the bypass comprises a second transverse bore connecting the suction channel and the parallel bore at a location upstream of the throttle.

Preferably, the carburetor comprises a third transverse bore, wherein the parallel bore extends perpendicularly through the third transverse bore and wherein the third transverse bore has a diameter that is greater than the diameter of the parallel bore.

Advantageously, the diameter of the parallel bore is 3 mm and the diameter of the third transverse bore is 4 mm.

In a preferred embodiment of the present invention the third transverse bore is a blind bore having an inner end wall and the parallel bore intercepts the third transverse bore near the inner end wall.

Preferably, the fuel supply line is connected to the control chamber and opens into the third transverse bore at the inner end wall.

The fuel supply line preferably comprises a throttle opening.

Advantageously, the throttle opening has a diameter of 0.3 mm.

In another embodiment of the present invention, the closure means is a piston positioned in the third transverse bore so as to be axially displaceable.

The piston preferably has a first end face proximal to the inner end wall for closing off the fuel supply line and an outer cylinder mantle surface for closing off the air supply line.

Advantageously, the first end face of the piston comprises a seal for sealingly contacting the inner end wall of the third transverse bore.

Advantageously, the carburetor further comprises an actuating rod, wherein the piston has a second end face distal to the inner end wall and wherein the actuating rod is connected to the second end face.

Expediently, the carburetor further comprises a spring acting on the piston for biasing the piston into the closed position so as to close the fuel supply line and the air supply line.

Advantageously, the carburetor further comprises a cap for closing off the third transverse bore, wherein the spring is a pressure coil spring supported at the cap and the pressure coil spring.

In yet another embodiment of the present invention, the carburetor further comprises a retaining device for retaining the closure means in an open position, in which the fuel supply line and the air supply line are open, until the starting operation is completed.

Preferably, the retaining device comprises a radial collar connected to the actuating rod and a trottle lever having a free end projecting into a travel path of the radial collar and being movable out of the travel path.

Advantageously, the radial collar comprises a frustoconical outer mantle surface facing away from the housing.

Preferably, the piston has a travel path of 3 to 7 mm between the open position and the closed position.

An especially simple and space-saving arrangement of the bypass is provided when the bypass is comprised of a parallel bore extending within the housing parallel to the suction channel and at least one transverse bore for connecting the parallel bore to the suction channel. This transverse bore opens into the suction channel downstream of the throttle. Expediently, the bypass comprises a second transverse bore which extends from the upstream end of the suction channel to the parallel bore. The parallel bore that forms the bypass extends perpendicularly to a third transverse bore having a diameter that is greater than the diameter of the parallel bore. In a preferred embodiment, the diameter of the parallel bore is preferably approximately 3 mm and the diameter of the third transverse bore is approximately 4 mm.

The third transverse bore is a blind bore. The parallel bore of the bypass intercepts the third transverse bore in the vicinity of the inner end wall of the third transverse bore. A fuel supply channel opens into the third transverse bore at the surface of the end wall. The fuel supply channel extends from the control chamber into the third transverse bore. Due to the design of the third transverse bore as a blind bore, its interception by the parallel bore of the bypass in the vicinity of the inner end wall, and the opening of the fuel supply channel in the area of this inner end wall, it is possible to close off with a single element the supply of fuel and air separately, i.e., before their mixing takes place. Preferably, the closure means for closing off the air supply and the fuel supply is a piston that is longitudinally displaceably guided within the third transverse bore. In the simplest manner, the closing of the fuel supply line and the air supply line is achieved by embodying the end face of the piston as a closure member for the fuel supply channel and by employing the mantle surface of the piston to close off the bore through which air is supplied. Since the closure of the fuel supply line requires higher standards than the closure of the air supply line, the piston is provided at its ends face preferably with an areal sealing which comes into contact with the inner end wall. Alternatively, the end face can also be provided with an O-ring or a needle tip for closing off the fuel supply line.

For closing off the air supply, no additional sealing means are required because the rate of leakage is within an immaterial range and has no influence on the operational behavior of the internal combustion engine. For actuating the piston, a rod is coupled to the end face of the piston which is distal to the sealing. An actuating member is preferably connected to the rod. In order to prevent that the piston accidentally remains in a position that opens the bypass, for example, due to carelessness of the operator, which would result in operation of the internal combustion engion with a too rich mixture, it is advantageous to provide that the piston be automatically returned into the closed position of the bypass. It is thus expedient to provide a spring for biasing the piston into the closed position. Such spring is advantageously a coil pressure spring supported with one end at the piston and with the other end at a cap that closes off the third transverse bore.

In order to achieve that the engine is operated for a certain time period after start-up with a richer mixture provided through the bypass, it is advantageous to provide a retaining device with which the closure means, for example, the aforementioned piston, is maintained in an open position until a certain operational condition of the engine has been reached upon which the bypass is closed. This retaining device, for example, may comprise a radial collar provided at the rod and a free end of a throttle lever. The free end projects into the travel path of the radial collar and can be moved out of this travel path. In order to facilitate movement of the piston with the aid of the rod into the open position in which the bypass is open, the radial collar is provided with a frustoconical mantle surface at the side facing away from the housing of the carburetor.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

The present invention will now be described in detail with the aid of a specific embodiment utilizing FIGS. 1 through 5.

Figure 1:
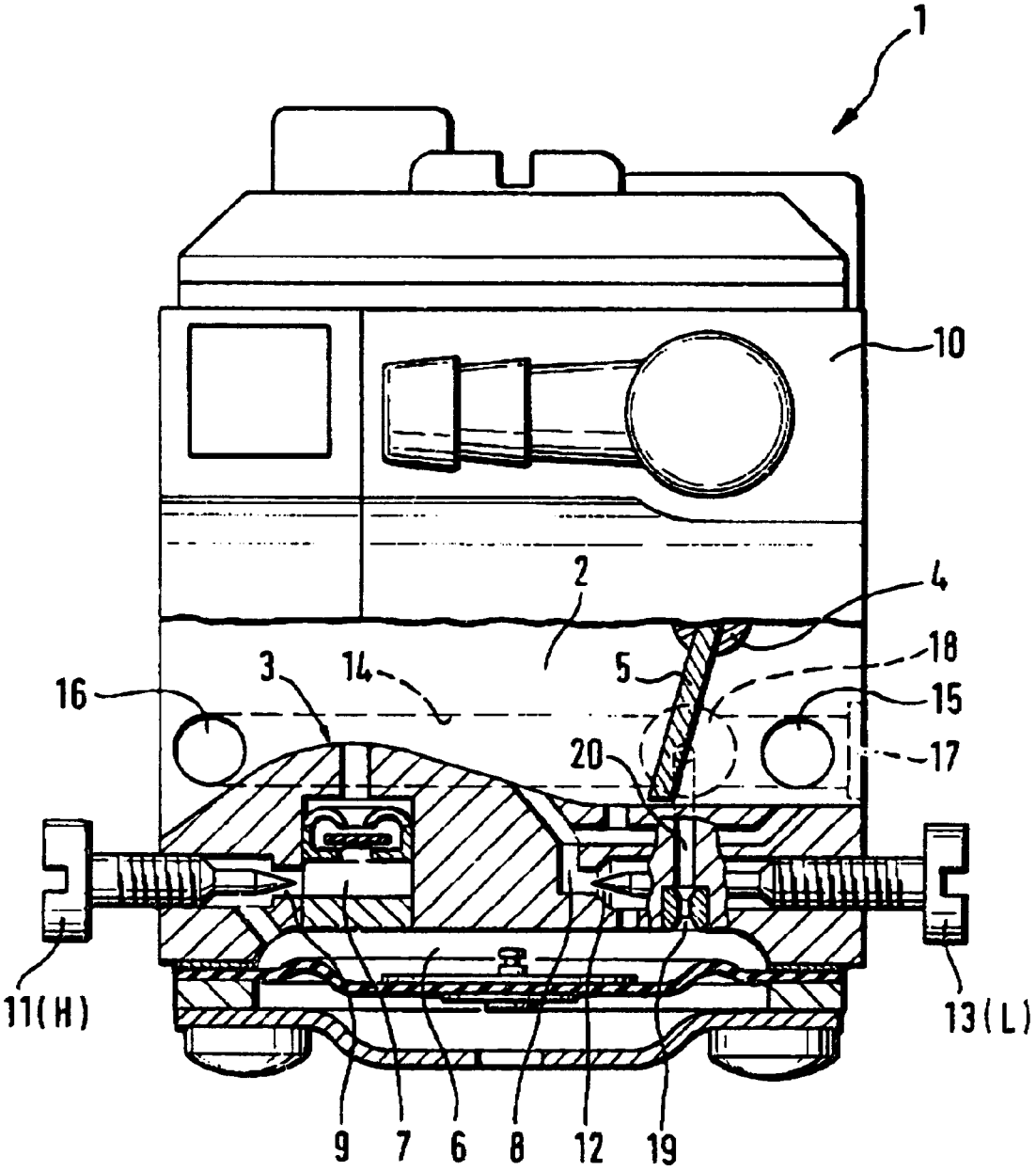
FIG. 1 shows a side view of a diaphragm carburetor, partially in longitudinal section.

The representation of FIG. 1 shows a diaphragm carburetor 1 whereby the upper half is an external view of the housing 10 and the lower half is a longitudinal section of the housing 10. In the housing 10 of the diaphragm carburetor 1 a suction channel 2 with a venturi section 3 is provided whereby within the suction channel 2, in the direction of air flow, downstream of the venturi section 3 a throttle 5 is connected to a shaft 4. In the lower area of the housing 10 a control chamber 6 is present which is connected via a main fuel channel 7 and an idle fuel channel 8 to the suction channel 2. The main fuel channel 7 opens in the area of the venturi section 3 into the suction channel 2 and is provided with a main fuel valve 9 the cross-section of which can be adjusted with an adjusting screw 11. In the idle fuel channel 8 an idle valve 12 is provided which is adjustable with adjusting screw 13. Downstream of the idle valve 12 the idle fuel channel 8 branches in order to open at different locations upstream and downstream of the throttle 5 into the suction channel 2.

Parallel to the suction channel 2 extends a parallel bore 14 which is connected with a first transverse bore 15 to the exit side of the suction channel 2, i.e., in flow direction downstream of the throttle 5, and with a second transverse bore 16 to the inlet end to the suction channel 2. In this manner, the bore 14 and the transverse bores 15 and 16 form a bypass for bypassing the throttle 5. The parallel bore 14 can be in the form of a blind bore and can be closed off by a stopper 17 or a similar means. The parallel bore 14 crosses perpendicularly a third transverse bore 18 which communicates via a fuel supply line 20 with a control chamber 6 in a manner which will be explained in the following.

Figure 2:
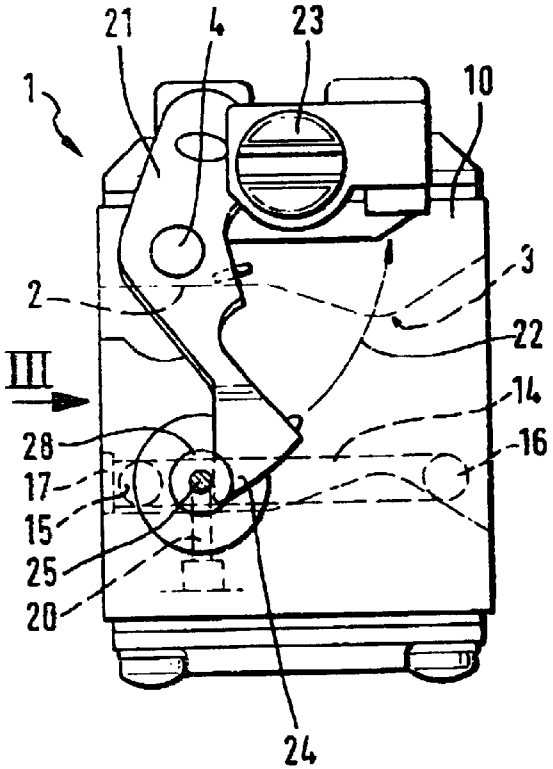
FIG. 2 shows a second side view of the carburetor.

FIG. 2 shows a further side view of the carburetor whereby for facilitating understanding of the drawing the suction channel 2 and the bypass formed by the bores 14, 15, and 16 are indicated in dashed lines. At the housing 10 a throttle lever 21 is connected to the end of the shaft 4. The throttle lever 21 is pivotable with a non-represented throttle pull or throttle linkage for actuating the throttle 5 in the direction of arrow 22. The closed position of the throttle 5 is adjustable with a control screw 23 acting on the throttle lever 21 in order to adjust the idling rpm. The free end 24 of the throttle lever 21 is positioned within the travel path of rod 25 in the idle position of the throttle 5, as will be described in the following with the aid of FIG. 3. The rod 25 is connected to an actuating member 31.

Figure 3:
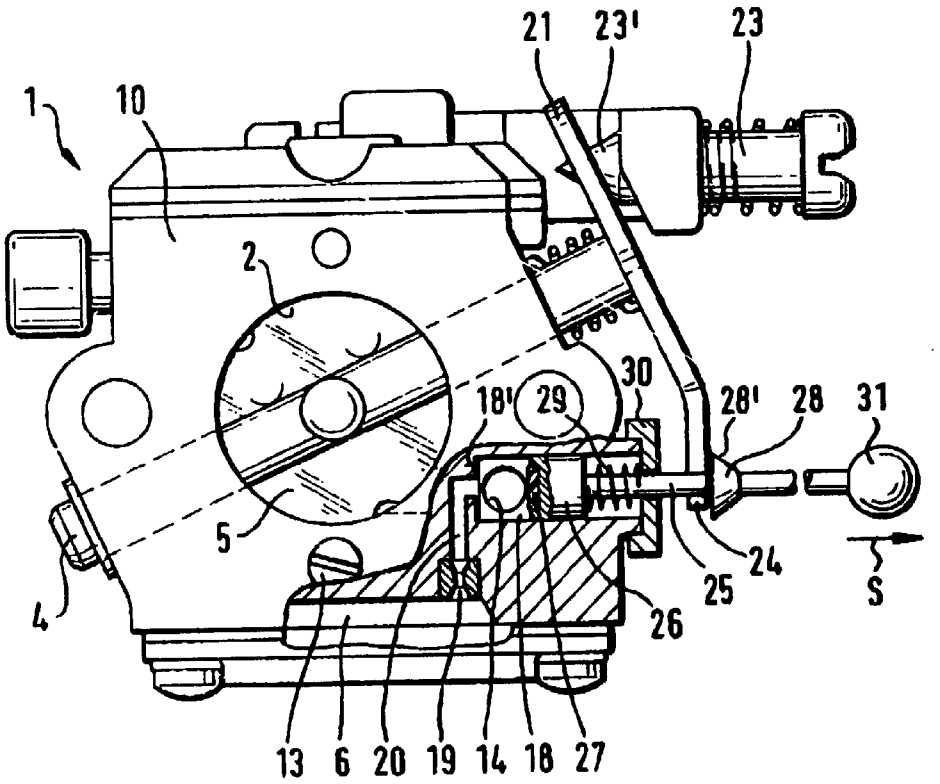
FIG. 3 shows an end view in the direction of arrow III of FIG. 2.

FIG. 3 shows a view in the direction of arrow III of FIG. 2 whereby only a portion is shown in section. The section extends through the plane in which the fuel supply line 20 and the third transverse bore 18 are located. The transverse bore 18 is a blind bore which has a slightly greater diameter than the parallel bore 14 extending perpendicularly therethrough in the vicinity of the inner end wall 18'. The diameter of the third transverse bore is preferably 4 mm. The diameter of the parallel bore 14 is preferably 3 mm.

The fuel supply line 20 opens at the inner end wall 18'. Its inlet end at the control chamber 6 has a fuel throttle 19 with a diameter of preferably 0.3 mm. A piston 26 is longitudinally displaceably positioned within the third transverse bore 18 and coupled to the rod 25. The end face of the piston 26 which is facing the inner end wall 18' is provided with an areal seal 27 so that upon resting at the inner end wall 18' the piston 26 acts as a valve closing the fuel supply line 20. The piston 26 is biased by a coil pressure spring 29 in the direction of closing. The coil spring 29 is supported at the cap 30, used for closing off the transverse bore 18, for automatically returning the piston 26 into its closed position.

The suction channel 2 with the throttle 5 arranged therein is illustrated in FIG. 3. The shaft 4 extends through the housing 10. To one end of the shaft 4 the throttle lever 21 is connected which is engaged by the conical tip 23' of the control screw 23 in order to adjust the closed position of the throttle 5. The free end 24 of the throttle lever 21 engages behind a radial collar 28 connected to the rod 25 (see FIG. 2). In this manner, the piston 26 is maintained, against the force of the pressure spring 29, in the position represented in FIG. 3 in which the fuel supply channel as well as the parallel bore 14 are open.

Figure 5:
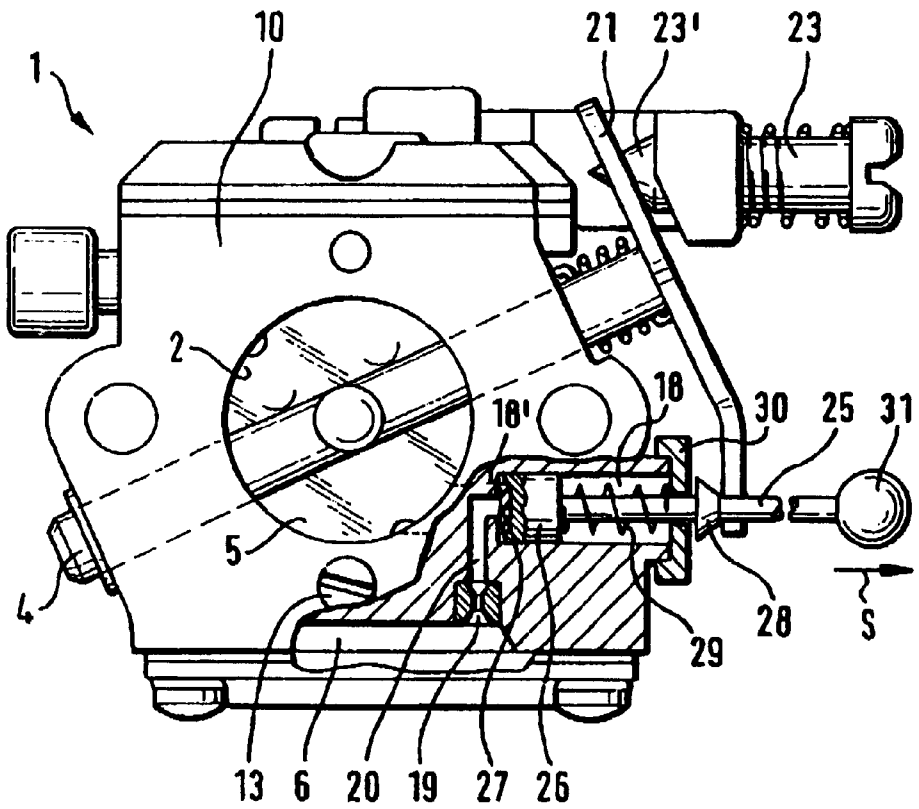
FIG. 5 shows an end view according to FIG. 3 in the same operational position as in FIG. 4.
Figure 4:
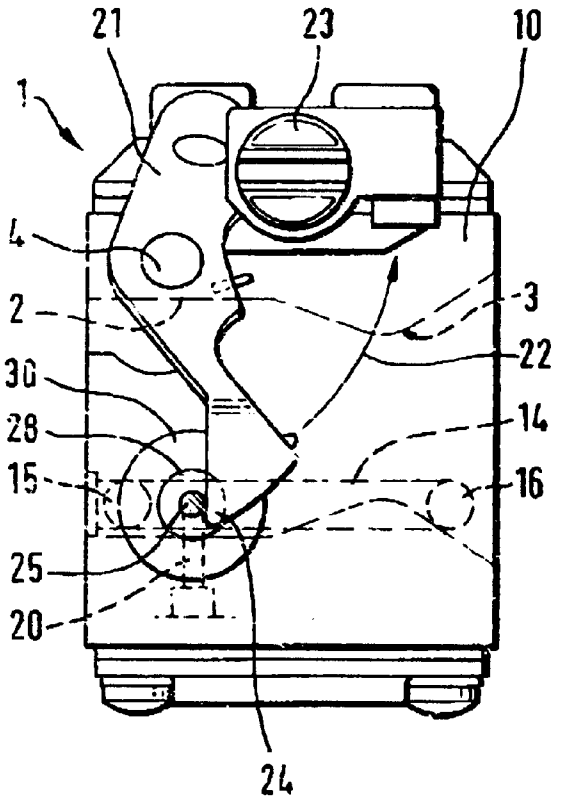
FIG. 4 shows an end view according to FIG. 2, but in a different operational position.

In FIGS. 4 and 5 the diaphragm carburetor 1 is illustrated in views which correspond to the views of FIGS. 2 and 3. However, the piston 26 is in a different operational position, i.e., contacts with its seal 27 the inner end wall 18' so that the fuel supply channel 20 is closed. The piston 26 also closes with its outer mantle surface the parallel bore 14. Due to the arrangement of the parallel bore 14 in the vicinity of the inner end wall 18', the travel path between open and closed position of the piston can be reduced to a minimum. For the aforementioned diameters of the parallel bore 14 of preferably 3 mm the travel path of the piston is only 4 mm. In the closed position of the piston 26 the pressure spring 29 is partially relaxed. The force of the spring is sufficient to maintain the piston securely in the closed position, and the free end 24 of the throttle lever 21 is disengaged from the radial collar 28 of the rod 25 which has, at the end face facing away from the carburetor, a frustoconical mantle surface 28'.

For starting the internal combustion engine the rod 25 is pulled with the actuating member 31 from the position shown in FIG. 2 in the direction indicated by arrow S. The piston 26 is thus displaced against the force of the pressure spring 29 and opens the fuel supply line 20 as well as the parallel bore 14. As soon as the position of the piston 26 represented in FIG. 3 has been reached, the end 24 of the throttle lever 21 catches behind the radial collar 28 and thus secures the rod 25 in the piston 26 in this position. Through the second transverse bore 16 and the parallel bore 14 air is sucked in which is mixed with the fuel exiting from the fuel supply line 20, and this fuel/air mixture is introduced into the suction channel 2 downstream of the throttle 5 via the first transverse bore 15. The internal combustion engine is thus supplied with an auxiliary fuel/air mixture so that during the start-up procedure an rpm is reached that is substantially higher than the idle speed. The arrangement remains in this operational position until the engine is accelerated for the first time.

For acceleration the throttle 5 is actuated whereby the throttle lever 21 is pivoted in the direction of arrow 22. Thus, the free end 24 is moved out of engagement with the radial collar 28 so that the pressure spring 29 forces the piston 26 onto the inner end face 18' of the bore 18 and interrupts in this manner air supply via the parallel bore 14 and fuel supply via the fuel supply line 20.

The present invention is, of course, in no way restricted to the specific disclosure of the specification and drawings, but also encompasses any modifications within the scope of the appended claims.

What I claim is:

1. A carburetor for an internal combustion engine of a hand-held working tool, said carburetor comprising:

a housing;

a suction channel with a venturi section arranged in said housing, said suction channel having an inlet and an outlet for allowing air flow therethrough;

a throttle connected in said suction channel so as to be pivotable;

a control chamber;

a main fuel channel connecting said suction channel and said control chamber;

an idle fuel channel connecting said suction channel and said control chamber;

a bypass, comprising an air supply line and a fuel supply line, for introducing an auxiliary fuel/air mixture during a starting operation of the internal combustion engine to a location of said suction channel downstream of said throttle in a direction of air flow; and a closure means for separately closing off in a closed position and air supply line and said fuel supply line of said bypass so that simultaneously the fuel supply and air supply are shut off before formation of the auxiliary fuel/air mixture.

2. A carburetor according to claim 1, wherein said bypass comprises a parallel bore extending within said housing parallel to said suction channel and a first transverse bore connecting said suction channel and said parallel bore, wherein said first transverse bore opens into said suction channel downstream of said throttle.

3. A carburetor according to claim 2, wherein said bypass comprises a second transverse bore connecting said suction channel and said parallel bore at a location upstream of said throttle.

4. A carburetor according to claim 3, further comprising a third transverse bore, wherein said parallel bore extends perpendicularly through said third transverse bore and wherein said third transverse bore has a diameter that is greater than a diameter of said parallel bore.

5. A carburetor according to claim 4, wherein the diameter of said parallel bore is 3 mm and the diameter of said third transverse bore is 4 mm.

6. A carburetor according to claim 4, wherein said third transverse bore is a blind bore having an inner end wall and wherein said parallel bore intercepts said third transverse bore near said inner end wall.

7. A carburetor according to claim 6, wherein said fuel supply line is connected to said control chamber and opens into said third transverse bore at said inner end wall.

8. A carburetor according to claim 7, wherein said fuel supply line comprises a throttle opening.

9. A carburetor according to claim 8, wherein said throttle opening has a diameter of 0.3 mm.

10. A carburetor according to claim 4, wherein said closure means is a piston positioned in said third transverse bore so as to be axially displaceable.

11. A carburetor according to claim 10, wherein said piston has a first end face proximal to said inner end wall for closing off said fuel supply line and an outer cylinder mantle surface for closing off said air supply line.

12. A carburetor according to claim 11, wherein said first end face of said piston comprises a seal for sealingly contacting said inner end wall of said third transverse bore.

13. A carburetor according to claim 10, further comprising an actuating rod, wherein said piston has a second end face distal to said inner end wall and wherein said actuating rod is connected to said second end face.

14. A carburetor according to claim 10, further comprising a spring acting on said piston for biasing said piston into said closed position so as to close off said fuel supply line and said air supply line.

15. A carburetor according to claim 14, further comprising a cap for closing off said third transverse bore, wherein said spring is a pressure coil spring supported at said cap and said pressure coil spring.

16. A carburetor according to claim 13, further comprising a retaining device for retaining said closure means in an open position, in which said fuel supply line and said air supply line are open, until said starting operation is completed.

17. A carburetor according to claim 16, wherein said retaining device comprises a radial collar connected to said actuating rod and a throttle lever having a free end projecting into a travel path of said radial collar and being moveable out of said travel path.

18. A carburetor according to claim 17, wherein said radial collar comprises a frustoconical outer mantle surface facing away from said housing.

19. A carburetor according to claim 16, wherein said piston has a travel path of 3 mm to 7 mm between said open position and said closed position.

* * * * *